US006371869B1

(12) United States Patent
Kato et al.

(10) Patent No.: US 6,371,869 B1
(45) Date of Patent: Apr. 16, 2002

(54) GOLF BALL WITH CORE AND SURROUNDING COVER

(75) Inventors: Akira Kato, Kobe; Keiji Moriyama; Satoshi Iwami, both of Akashi, all of (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 09/658,041

(22) Filed: Sep. 8, 2000

(30) Foreign Application Priority Data

Sep. 8, 1999 (JP) ..... 11-254042

(51) Int. Cl.[7] ..... A63B 37/06; A63B 37/12; A63B 37/14

(52) U.S. Cl. ..... 473/365; 473/361; 473/357; 473/356; 473/378

(58) Field of Search ..... 473/356, 357, 473/361, 362, 363, 364, 365, 370, 371, 374, 376, 377, 378

(56) References Cited

U.S. PATENT DOCUMENTS 4,884,814 A 12/1989 Sullivan
5,704,853 A * 1/1998 Maruko et al. ..... 473/363
5,716,293 A 2/1998 Yabuki et al.
5,810,677 A * 9/1998 Maruko et al. ..... 473/357
5,816,941 A * 10/1998 Hayashi et al. ..... 473/359
6,114,453 A * 9/2000 Irii et al. ..... 525/221

FOREIGN PATENT DOCUMENTS

| | | |
|---|---|---|
| EP | 0636390 | 2/1995 |
| GB | 2216429 | 10/1989 |
| GB | A2311530 | 10/1997 |

OTHER PUBLICATIONS

Merriam–Webster's Collegiate Dictionary, www.m–w.com.*

Callister, Jr., Materials Science and Engineering: An Introduction, Fourth Edition. New York: John Wiley & Sons, Inc. 1997, p. 498.*

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

A thread-wound golf ball is provided including a core, a rubber thread layer surrounding the core, and a cover formed of a mixture of ionomer resin, thermoplastic elastomer and a tackifier, having a Shore D hardness of at least 40 and not more than 65.

8 Claims, 1 Drawing Sheet

GOLF BALL WITH CORE AND SURROUNDING COVER

BACKGROUND OF THE INVENTION

1. Field of the Invention

The present invention relates to a golf ball with a core and a cover surrounding the core. Particularly, the present invention relates to a thread-wound golf ball that exhibits great carry distance with favorable hit feeling, and that easily comes to a halt even though exhibiting high spinning when shot from the rough or when shot in a raining condition such as a balata covered golf ball.

2. Description of the Background Art

Conventional golf balls formed with a thread-wound layer around a liquid center and surrounded by a balata cover are widely used by low-handicapped golfers and professional golfers. However, the structure of such golf balls has the disadvantage that the fabrication process is difficult and the cut resistance is inferior. Various soft cover materials have been recently proposed as a substitute for balata covers.

For example, U.S. Pat. No. 4,884,814 discloses the usage of soft ionomer resins for the basic resin of the cover.

Also, the basic resin of a cover disclosed in GB2311530 is formed having as the main component a heated mixture of two components, i.e. ionomer resin, and a styrene-butadiene-styrene block copolymer including a polybutadiene block containing an epoxy group or a styrene-isoprene-styrene block copolymer including a polyisoprene block containing an epoxy group. This publication proposes a golf ball characterized in that the cover composition forming the cover has a flexural modulus of 50–300 MPa and a Shore D hardness of 40–60.

The inventors of the present invention have already proposed a golf ball directed to improve the hit feeling and the spin rate when shot with a short iron by virtue of the usage of a solid rubber center including oily substance and a soft cover material (U.S. Pat. No. 5,716,293).

However, the bounce and the hit feeling are not completely satisfactory since oil-resistant rubber or ionomer resin of high hardness is employed for the outer side of the solid rubber center. With the conventional soft cover material, the spin rate in a wet condition is inferior to the spin rate in a dry condition. Therefore, these golf balls were not satisfactory also from the aspect of spin maintenance.

SUMMARY OF THE INVENTION

An object of the present invention is to provide a thread-wound golf ball solved in the problems encountered in conventional thread-wound golf balls, exhibiting soft and favorable hit feeling with a great carry distance such as a thread-wound golf ball with a liquid core, and that can easily come to a halt though the spin rate is great when shot from the rough or when shot in a raining condition such as a balata-covered golf ball.

The above object is achieved by a golf ball of the present invention set forth in the following.

According to an aspect of the present invention, a thread-wound golf ball is constituted by a core, a rubber thread layer surrounding the core, and a cover formed of a mixture of ionomer resin, thermoplastic elastomer and a tackifier, having a Shore D hardness of at least 40 and not more than 65.

According to another aspect of the present invention, a thread-wound golf ball includes the above core, wherein the core is formed of two layers of an inner layer core having a diameter of 24–33 mm and the JIS-A hardness of at least 5 and not more than 50, and an outer layer core covering the inner layer core, having a thickness of 0.5–5 mm and a diameter of 25–35 mm with a Shore D hardness of at least 10 and not more than 60. The outer layer core is formed of thermoplastic resin and/or thermoplastic elastomer.

According to a further aspect of the present invention, the thermoplastic elastomer forming the above cover of a thread-wound golf ball includes a styrene-butadiene-styrene block copolymer (SBS structure), or a hydrogenate thereof, or a modified product thereof.

According to still another aspect of the present invention, the thermoplastic elastomer forming the above cover of a thread-wound golf ball includes a styrene-isoprene-styrene block copolymer (SIS structure), or a hydrogenate thereof, or a modified product thereof.

According to a still further aspect of the present invention, the above tackifier in a thread-wound golf ball includes terpene resin and/or rosin ester resin.

According to yet a further aspect of the present invention, the thermoplastic elastomer forming the outer layer core of a thread-wound golf ball includes a mixture of one or at least two types of polystyrene based elastomer, polyolefin based elastomer, polyurethane based elastomer, and polyester based elastomer.

The foregoing and other objects, features, aspects and advantages of the present invention will become more apparent from the following detailed description of the present invention when taken in conjunction with the accompanying drawing.

DESCRIPTION OF THE PREFERRED EMBODIMENTS

Figure 1:
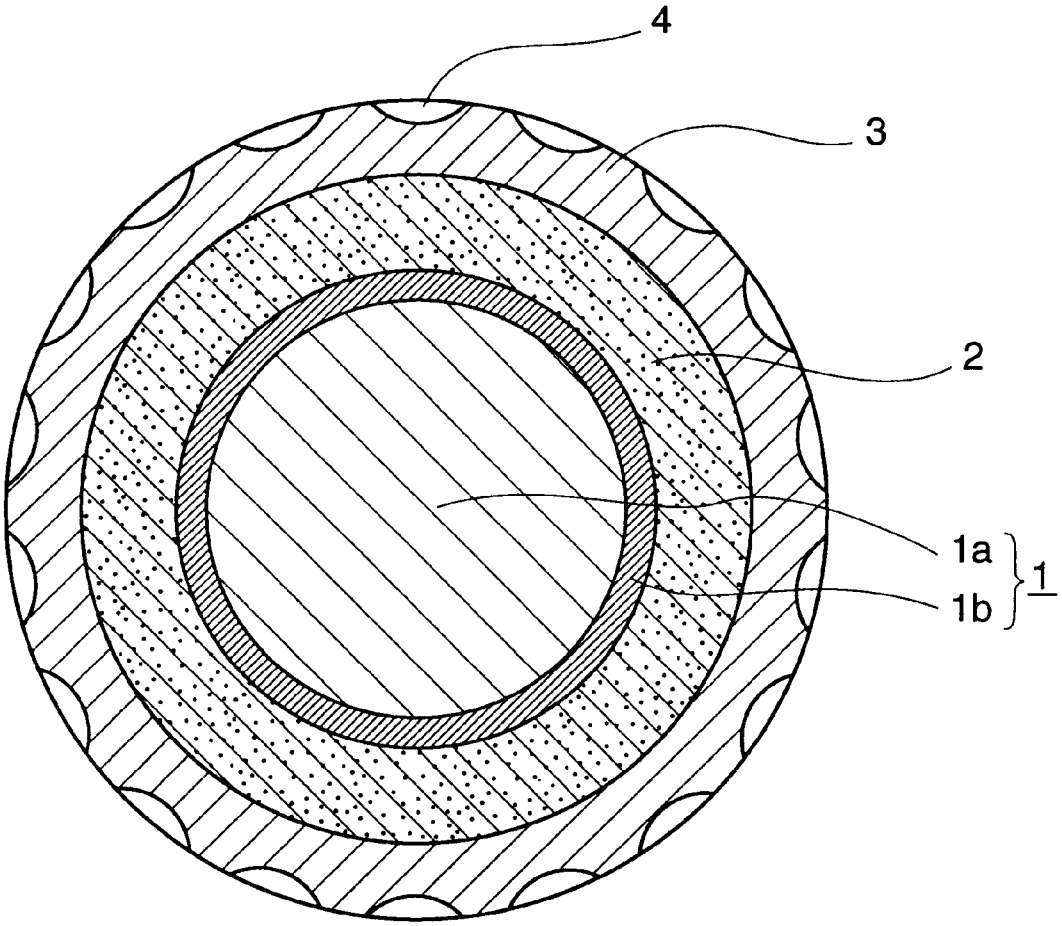
FIG. 1 is a sectional view schematically showing one manner of a golf ball according to the present invention.

The structure of a golf ball of the present invention will be described with reference to FIG. 1. FIG. 1 is a sectional view schematically showing one manner of the golf ball of the present invention. As shown in FIG. 1, the golf ball of the present invention has a rubber thread layer 2 wound around a solid core 1 formed of an inner layer core 1*a* and an outer layer core 1*b*. A cover 3 is formed on rubber thread layer 2.

Inner layer core 1*a* is formed of a vulcanizate of a rubber composition including an oily substance. The basic rubber to obtain the rubber composition is rubber that can be vulcanized with sulfur or peroxide. For example, polybutadiene rubber (BR), natural rubber (NR), ethylene-propylene-diene monomer ternary copolymer rubber (EPDM), polynorbornene rubber, and the like are suitable for usage. Also, styrene based elastomer, ethylene based elastomer, or urethane based elastomer can be mixed for usage. It is desirable that the basic rubber is highly soluble with and can be highly filled with an oily substance, and has an appropriate impact resilience when a crosslinked structure is formed with the oily substance dispersed evenly in the rubber.

The oily substance has flowability or a semi-solid shape at room temperature with low volatility. It is particularly desirable that the oily substance is highly soluble with the foregoing rubber to be mixed evenly in the rubber without degrading the bounce of the rubber. Alternatively, it is desirable that the oily substance can provide appropriate impact resilience when mixed into rubber of low bounce. Oily substances are set forth in the following.

(1) Petroleum Blended Oil

Used as the extension oil of rubber, including paraffin based oil (including at least 50% of paraffin chain), naphthene based oil (including 30–45% of naphthene ring carbon), aromatic based oil (including at least 30% of aromatic carbon), or the like.

(2) Plasticizer

Phthalate base such as dibutyl phthalate (DBP), dioctyl phthalate (DOP), adipate base such as dioctyl adipate (DOA), sebacate base such as dioctyl sebacate (DOS), phosphate base such as tricresyl phosphate (TCP), adipic acid based polyester, or the like can be enumerated.

(3) Sub (factice)

Corresponding to vegetable oil or the like vulcanized with sulfur or sulfur chloride. Semi-translucent factice, brown factice, and the like can be enumerated.

(4) Alkyl Benzene 1-dodecyl-4-hexyl benzene, 1-dodecyl-3-hexyl benzene, 1, 2, 3 hemimellitene, and the like can be enumerated.

(5) Liquid Rubber

Liquid polybutadiene, liquid polyisoprene, and the like can be enumerated.

The oily substance can be used alone, or be mixed with two or more types.

The combination of the oily substance and the basic rubber is determined taking into consideration the solubility of the oily substance with the rubber. Favorable combinations include, for example, polybutadiene rubber, natural rubber and naphthene based oil or aromatic based oil, EPDM and paraffin based oil, polynorbornene rubber and naphthene based oil, aromatic based oil, plasticizer, alkyl benzene, paraffin based oil, urethane rubber and a plasticizer or sub.

The blended amount of the oily substance is approximately 30–500 parts by weight, more preferably 50–400 parts by weight, with respect to 100 parts by weight of basic rubber. If the blended amount is less than 30 parts by weight, the effect of improvement cannot be expected. If the blended amount exceeds 500 parts by weight, there is a possibility that the oil cannot be mixed in the rubber depending upon the combination.

In addition to the basic rubber and the oily substance, inner layer core 1*a* of the present invention can be added with a filler (for example, barium sulfate) as a specific gravity adjuster, a reinforcer (for example, water-containing silicic acid, carbon black), a processing aid as a tackifier, an oxidation inhibitor and the like. In the case where vulcanization with sulfur is to be carried out, sulfur, zinc oxide, stearic acid, a vulcanization accelerator, zinc stearic acid or the like can be added as the vulcanization type chemicals. In the case where vulcanization is carried out with peroxide, an appropriate amount of organic peroxide (for example, dicumyl peroxide, 1, 1-di-t-butylperoxide-3, 3, 5-trimethyl cyclohexane), an activator (for example, zinc stearic acid), zinc oxide, a covulcanizer (for example, zinc acrylic acid, zinc methacrylic acid, N, N'-m-phenylene dimaleimide) can be added for a rubber composition that allows vulcanization.

Inner layer core 1*a* of the present invention can be obtained by kneading the foregoing rubber composition, and vulcanizing the rubber composition in a mold for 10–20 minutes at 150° C.–170° C., for example. Inner layer core 1*a* of the golf ball of the present invention has a diameter of 24–33 mm, preferably 25–32 mm, more preferably 25–31 mm. If the diameter of inner layer core 1*a* is smaller than 24 mm, the soft property of the core is lost. The spin rate when shot is increased to reduce the carry distance. Also, the hit feeling is degraded. If the diameter thereof is greater than 33 mm, outer layer core 1*b* becomes so thin that appropriate hardness when formed as a ball will not be achieved. This means that the appropriate hardness cannot be obtained.

The JIS-A hardness of inner core 1*a* is not more than 50, preferably not more than 45. If the hardness of inner layer core 1*a* becomes greater than 50, the core becomes too hard that the spin rate when shot is increased to reduce the flight distance. Also, the hit feeling is degraded. If inner layer core 1*a* becomes too soft, molding of outer layer core 1*b* will become difficult. Also, the core will be easily deformed when the rubber thread is wound. Therefore, the JIS-A hardness of inner layer core 1*a* is at least 5, preferably at least 10, more preferably at least 15, and further preferably at least 20.

Outer layer core 1*b* of the present invention serves to prevent bleeding of the oily substance included in inner layer core 1*a*. Outer layer core 1*b* is formed of a composition having a Shore D hardness of not more than 60, preferably not more than 55, with thermoplastic resin and/or thermoplastic elastomer as the main material. If the Shore D hardness becomes greater than 60, the core will become too hard to increase the spin rate when shot, whereby the flight distance is reduced. Also, the hit feeling is degraded. If the core becomes too soft, the bounce will be degraded. Therefore, outer layer core 1*b* has the JIS-A hardness of at least 55, and a Shore D hardness of at least 10, preferably at least 15. As to the relationship of hardness between inner layer core 1*a* and outer layer core 1*b*, outer layer core 1*b* may be softer than inner layer core 1*a*, provided that they are within the respective ranges of hardness. It is preferable that the following relationship of hardness therebetween represented in the JIS-A hardness is satisfied. By satisfying this relationship, high bounce and favorable hit feeling can both be achieved.

$$(\text{outer layer core hardness} - \text{inner layer core hardness}) \geqq 10$$

As the thermoplastic resin included in the outer layer core of the present invention, polyurethane resin, ionomer resin, nylon, polyethylene, and the like can be used. The thermoplastic elastomer includes a soft segment and a hard segment in the molecule, and can be used mixing at least one type of polystyrene based elastomer, polyolefin based elastomer, polyurethane based elastomer and polyester based elastomer, for example.

As specific examples of the polystyrene type elastomer, the trade names of ESBS A1010 from Daicel Chemical Industries Ltd. and Septon HG-252 from Kuraray Co., Ltd. can be enumerated.

As specific examples of the polyolefin based elastomer, Milastomer M4800NW from Mitsui Chemical Industries Ltd., Sumitomo TPE 3682, 9455 from Sumitomo Chemical Co., Ltd. can be enumerated.

As specific examples of the urethane based elastomer, Kuramilon 9195, 9180 from Kuraray Co., Ltd., Elastollan ET880 from Takeda Badische Urethane Industries Ltd. can be enumerated.

As specific examples of the polyester based elastomer, Hytrel 4047, 4767, 5557 from Toray-DuPont Co., Ltd. can be enumerated.

Although outer layer core 1*b* of the present invention can be formed by the unitary polymer material of the foregoing thermoplastic resin and/or thermoplastic elastomer, a specific gravity adjuster such as barium sulfate, tungsten, or the like can be blended in addition to the foregoing thermoplastic resin and thermoplastic elastomer. The outer layer core preferably includes the foregoing thermoplastic elastomer, having a blended amount of at least 50% by weight, preferably at least 80% by weight, more preferably at least 90% by weight, with respect to the total weight of external layer core 1*b*.

Outer layer core 1*b* can be fabricated using the general method employed in the formation of the cover of a golf ball. The composition for the outer layer core is provided in a hemispherical shape half shell in advance. Two thereof is used to enclose the inner layer core, followed by molding with pressure. Alternatively, the composition for the outer layer core can be injection-molded directly on the inner layer core to enclose the same. Thus, an outer layer core of 0.5–5 mm in thickness is formed on the inner layer core to obtain a solid core 1. Solid core 1 has a diameter of 25–34 mm, preferably 26–32 mm. If the diameter is smaller than 25 mm, the spin rate when shot is increased to reduce the flight distance. If the diameter is larger than 34 mm, the rubber thread layer becomes so thin that the hardness when formed as a ball is not achieved. As a result, the appropriate hardness cannot be obtained.

A rubber thread for a golf ball is wound around the obtained solid core 1 to form a thread-wound center including solid core 1 and rubber thread layer 2. The rubber thread wound around solid core 1 may be of the material conventionally used for the thread wound layer of a thread-wound golf ball such as natural rubber or a vulcanized rubber composition having sulfur, a vulcanization aid, a vulcanization accelerator, an antioxidant or the like blended with natural rubber and synthesis polyisoprene. Rubber thread layer 2 can be wound on the solid core with the conventional method of fabricating a thread-wound core of a thread-wound golf ball. The thickness of rubber thread layer 2 is 1.5–7.5 mm, preferably 2.0–7.0 mm. If the thickness thereof is thinner than 1.5 mm, the bounce of the rubber thread is not effected. If the thickness is greater than 7.5 mm, the spin rate when shot is increased to exhibit a trajectory that flies highly upwards, whereby the flight distance is reduced. Cover 3 is formed on the obtained rubber thread layer 2.

In the present invention, the ionomer resin employed as the basic resin of the cover is, for example, a binary copolymer of α-olefin and α, β-unsaturated carboxylic acid having 3–8 carbon atoms, obtained by neutralizing at least a portion of the carboxyl group thereof with metallic ion. Alternatively, a ternary copolymer of α-olefin, α, β-unsaturated carboxylic acid having 3–8 carbon atoms, and α, β-unsaturated carboxylic acid ester having 2–22 carbon atoms, obtained by neutralizing at least a portion of the carboxyl group thereof with metallic ion can be employed. As to the composition ratio, 80–90% by weight of α-olefin and 10–20% by weight of α, β-unsaturated carboxylic acid are preferable when the base polymer of the ionomer resin is a binary copolymer of α-olefin and α, β-unsaturated carboxylic acid having 3–8 carbon atoms. When the base polymer is a ternary copolymer of α-olefin, α, β-unsaturated carboxylic acid having 3–8 carbon atoms and α, β-unsaturated carboxylic acid ester having 2–22 carbon atoms, 70–85% by weight of α-olefin, 5–20% by weight of α, β-unsaturated carboxylic acid and 10–25% by weight of α, β-unsaturated carboxylic acid ester are preferable. It is also preferable that the melt index (MI) of these ionomer resins is 0.1–20, particularly 0.5–15.

As the α-olefin, ethylene, propylene, 1-butene, 1-pentene, for example, are employed, wherein ethylene is particularly preferable. As the α, β-unsaturated carboxylic acid having 3–8 carbon atoms, acrylic acid, methacrylic acid, fumaric acid, maleic acid, crotonic acid, for example, are employed, wherein acrylic acid and methacrylic acid are particularly preferable. As the unsaturated carboxylic acid ester, methyl, ethyl, propyl, n-butyl, isobutyl ester or the like of acrylic acid, methacrylic acid, fumaric acid, maleic acid or the like, for example, are employed, wherein acrylic acid ester and methacrylic acid ester are particularly preferable. As the metallic ion neutralizing at least a portion of the carboxyl group in the foregoing copolymer of α-olefin and α, β-unsaturated carboxylic acid or the foregoing ternary copolymer of α-olefin, α, β-unsaturated carboxylic acid and α, β-unsaturated carboxylic acid ester, sodium ion, lithium ion, zinc ion, magnesium ion, potassium ion, for example, can be enumerated. When the ionomer resin has at least a portion of the carboxyl group in the copolymer of ethylene and acrylic acid or methacrylic acid neutralized with metallic ions, the highly rigid and high flow type having a melt index of 3–7 and a flexural modulus of 200–400 MPa is preferable.

Specific trade names of the ionomer resin are enumerated in the following. Hi-milan 1555 (Na), Hi-milan 1557 (Zn), Hi-milan 1605 (Na), Hi-milan 1706 (Zn), Hi-milan 1707 (Na), Hi-milan AM7318 (Na), Hi-milan 1706 (Zn), Hi-milan AM7315 (Zn), Hi-milan AM7317 (Zn), Hi-milan AM7311 (Mg), and Hi-milan MK7320 (K) sold by Mitsui-DuPont Polychemical Co., Ltd. are available. As the ternary copolymer ionomer resin, Hi-milan 1856 (Na), Hi-milan 1855 (Zn), and Hi-milan AM7316 (Zn) are available from Mitsui-DuPont Polychemical Co., Ltd. As ionomer resins sold by DuPont Co. are available Surlyn 8945 (Na), Surlyn 8940 (Na), Surlyn 8945 (Na), Surlyn 9910 (Zn), Surlyn 9945 (Zn), Surlyn 7930 (Li), and Surlyn 7940 (Li)7 are available. As the ternary copolymer type ionomer resin, Surlyn AD8265 (Na) and Surlyn AD8269 (Na) are available from DuPont Co.

As ionomer resins available from Exxon Chemical Japan Ltd., Iotek 7010 (Zn), Iotek 8000 (Na) and the like are available. Na, Zn, K, Li, Mg and the like in the above parenthesis following respective trade names of the ionomer resin indicate the metal type of these neutral metallic ions. In the present invention, the ionomer resin employed in the basic resin of the cover may have at least two of those enumerated above can be mixed. Alternatively, at least two types of the ionomer resin neutralized with monovalent metallic ions enumerated above and ionomer resin neutralized with divalent metallic ions can be mixed to be used.

The basic resin of the cover of the present invention has at least one type of thermoplastic elastomer with a soft segment and a hard segment mixed into the ionomer resin. As the thermoplastic elastomer, the materials of each type used for the external layer core can be employed. Particularly, a block copolymer having a conjugated diene compound such as butadiene block or isoprene block is particularly suitable. As the conjugated diene compound, one or at least two types can be selected from, for example, butadiene, isoprene, 1, 3-petadiene, 2, 3-dimethyl-1, 3-butadiene. Particularly, butadiene, isoprene, and a combination thereof are preferable. As a component forming other block copolymers, one or at least two types can be selected from styrene, α-methyl styrene, vinyl toluene, ρ-3 butyl styrene, 1, 1-diphenyl ethylene, wherein styrene is preferable.

As specific examples of block copolymers, styrene-butadiene-styrene block copolymer (SBS structure), styrene-ethylene-butylene-styrene block copolymer corresponding to the hydrogenated double bonded portion of the butadiene thereof (SEBS structure), styrene-isoprene-styrene block copolymer (SIS structure), styrene-ethylene-propylene-styrene block copolymer corresponding to the hydrogenated double bonded portion of that isoprene (SEPS structure), and a modified product thereof can be enumerated.

The containing amount of styrene of the foregoing SBS structure, SEBS structure, SIS structure and SEPS structure (or an alternative monomer) is in the range of 10–50% by weight, particularly 15–45% by weight in the copolymer. If the containing amount is less than 10% by weight, the cover will become so soft that the cut resistance is degraded. If the containing amount is greater than 50% by weight, the ionomer resin cannot be softened sufficiently to degrade the hit feeling and controllability.

In the present invention, an epoxy group can be included as a part of the copolymer of the foregoing SBS, SEBS, SIS and SEPS structure.

For example, the styrene-butadiene-styrene block copolymer (SBS structure) including a polybutadiene block with an epoxy group is a block copolymer having polystyrene at both terminals with an intermediate layer of polybutadiene containing the epoxy group, wherein a portion or all of the double bond of the polybutadiene portion is hydrogenated. The styrene-isoprene-styrene block copolymer having a polyisoprene block containing an epoxy group (SIS structure) is a block copolymer having polystyrene at both terminals with an intermediate layer of polyisoprene containing the epoxy group, wherein a portion or all of the double bond of the polyisoprene portion is hydrogenated.

The containing amount of the epoxy group in the block copolymer of the epoxidized SBS structure or SIS structure is 0.05–10% by weight, particularly 0.2–5% by weight. If the containing amount of the epoxy group is smaller than 0.05% by weight, reaction between the epoxy group and the free carboxyl group in the ionomer resin is reduced to degrade the dispersion of the block copolymer of the epoxidized SBS structure or SIS structure in the ionomer resin. There is a possibility that the durability is degraded. If the containing amount of epoxy is larger than 10% by weight, reaction between the epoxy group and the free carboxyl group in the ionomer resin becomes excessive to degrade the flowability. There is a possibility that ball-molding becomes difficult.

As products of the block copolymer of the epoxidized SBS structure or SIS structure available on the market, the styrene-butadiene-styrene block copolymer including a polybutadiene block containing an epoxy group (SBS structure) sold under the trade name of ESBS A1010 from Daicel Chemical Industries Ltd., and the styrene-butadiene-styrene block copolymer corresponding to a hydrogenated portion of a polybutadiene block including an epoxy group sold under the trade name of ESBS AT018 and ESBS AT019 from Daicel Chemical Industries Ltd. can be enumerated. All of these products are suitable in the present invention.

As a product of a block copolymer of the SEBS or SEPS structure having a hydroxyl group added to the terminal available on the market, Septon HG-252 from Kuraray Co., Ltd., for example, is available.

In the present invention, the mixing ratio of the ionomer resin to the thermoplastic elastomer such as the block copolymer of the SBS or SIS structure is 95:5–30:70, particularly 80:20–40:60 in weight ratio. If the amount of the ionomer resin exceeds the foregoing range, the ionomer resin cannot be softened sufficiently. The property of ionomer resin will be exhibited too strongly so that the hit feeling or controllability will be degraded. If the amount of the ionomer resin is lower than the foregoing range, the cover will become too soft to increase the spin rate. As a result, there is a possibility that the carry distance is reduced and the cut resistance degraded.

In the present invention, the desired cover characteristics can be obtained by heating and mixing the foregoing ionomer resin with the thermoplastic elastomer of the SBS or SIS structure. The heat-mixing process is carried out at, for example, 150–260° C. using an internal mixer such as the general two-shaft kneading type extruder, Banbury, kneader, or the like.

The tackifier employed in the cover of the present invention includes coumarone-indene based resin, terpene based resin, rosin derivative, phenol-formaldehyde based resin, alkyl phenol based resin, petroleum based resin, xylene-formaldehyde based resin, oligomer of polybutene, liquid rubber such as liquid polyisoprene and the like. Particularly, terpene resin and rosin ester based resin are preferably applicable.

The foregoing terpene resin is a terpene polymer and a polymer with a polymer chain as the second component, including the terpene resin whose basic structure is shown by the following general formula (1), styrene based terpene resin whose basic structure is shown by the following general formula (2), phenol modified terpene resin whose basic structure is shown by the following general formula (3), and hydrogenated terpene resin thereof.

Formula (1)

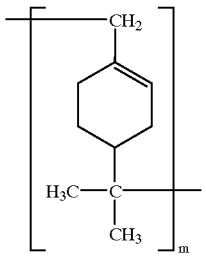

Formula (2)

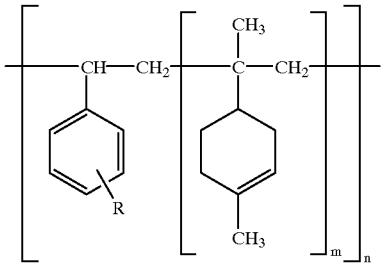

Formula (3)

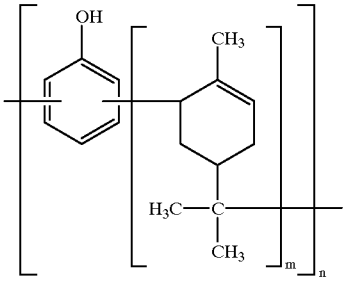

In the above formulas of (1)–(3), m and n are integers.

Specific trade names of the tackifier are set forth in the following. As the coumarone resin, Process Resin A81, Process Resin AC5, and Process Resin TX from Kobe Oil Chemical Industry Co., Ltd., Coumarone CL from Ouchi-shinko Chemical Industries Ltd., and coumarone resin NG4 from Nippon Steel Chemical Industries Ltd. are available. As the terpene-phenol resin, Tackirol 101, Tackirol 160, Tackirol EP20, and Tackirol EP30 from Sumitomo Chemical Co., Ltd., and Sumilight resin PR19900 from Sumitomo Dulez Co., Ltd. are available.

As the petroleum based resin, hydrogenated terpene resin Clearon P105 from Yasuhara Chemical Co., Ltd., Arkon P90 and Ester gum H from Arakawa Chemical Industries Ltd., Petroresin #80 and Hilets G100X from Mitsui Petrochemical Industries Ltd. are available.

As the rosin derivative, Nikanol A70 from Mitsubishi Gas Chemical Co., Inc., Lignol R70 from Libnite, and rosin ester resin from Arakawa Chemical Industries Ltd. are available.

The foregoing tackifier is mixed in a dispersed manner in the basic resin of the cover to provide appropriate adherence to the cover. Accordingly, the adherence on the club face is improved when hitting the golf ball. To this end, 5–50 parts by weight, preferably 10–40 parts by weight, particularly preferably 20–30 parts by weight of the tackifier is blended with respect to 100 parts by weight of the basic resin material of the cover (including thermoplastic elastomer). If the blended amount is less than 5 parts by weight, sufficient adherence cannot be provided to the cover. If the blended amount exceeds 50 parts by weight, there is a tendency of degradation in the cover's basic characteristics of hardness, feeling and durability.

In the present invention, the blending ratio of the ionomer resin, the thermoplastic elastomer, and the tackifier is preferably 30–70/20–60/10–30 with respect to 100 parts by weight of the total of the three components. If the blended amount of the ionomer resin is too small, the hardness becomes so low that the rebounce is degraded. If the blended amount of the ionomer resin is too large, the spin maintenance is reduced. If the blended amount of the thermoplastic elastomer is too small, the effect of the tackifier does not easily appear. As a result, the spin maintenance is reduced. If the blended amount of the thermoplastic elastomer is too large, the hardness will be too low.

Cover 3 of the present invention has a Shore D hardness of 40–65, preferably 43–63, more preferably 45–60 under the state covering the thread-wound core, i.e. the cover hardness. If the Shore D hardness is less than 40, the ball will become too soft, so that the initial velocity of the ball will be low. If the hardness exceeds 60, the spin rate when shot using a short iron or the like will be reduced. Here, the Shore D hardness is measured according to ASTMD-2240.

The composition of the cover in the present invention can include, if necessary, in addition to the foregoing resin corresponding to the main component, a filler such as barium sulfate or a pigment such as titanium dioxide, and also other additives such as a dispersion, an antioxidant, an ultraviolet absorber, photo-stabilizer, a fluorescent material or a fluorescent brightening agent, provided that the amount thereof is within the range that does not deteriorate the desired characteristics of the golf ball cover. In general, the blended amount of the pigment is preferably 1.0–6.0 parts by weight.

Cover 3 of the present invention can be formed by the well-known method. The cover composition is formed in advance into a hemispherical-shaped half shell. Two thereof enclose the thread-wound core, followed by a molding process with pressure at 130–170° C. for 1–5 minutes. Alternatively, the cover composition can be injection-molded directly on the thread-wound core to enclose the same. Cover 3 has a thickness of 1.0–3.0 mm, preferably 1.2–2.5 mm. If the thickness thereof is smaller than 1.0 mm, there is a disadvantage that the cover easily cracks when hit repeatedly. If the thickness of cover 3 is greater than 3.0 mm, the hit feeling is deteriorated. Also, a plurality of dimples 4 are formed as necessary on the surface during the cover molding process. For the purpose of improving the aesthetic appearance to raise the commercial value, the golf ball of the present invention is generally applied with paint and stamped with marking to be provided on the market.

The cover of the present invention can be formed of one layer or a plurality of layers.

The present invention will be described according to Examples 1–4 of the present invention and Comparative Examples 1–4

(1) Production of Inner Layer Core

The rubber compositions for an inner layer core of the blend shown in the following Table 1 were kneaded and subjected to heat-pressing in a mold for 160° C.×15 minutes to produce an inner layer core.

TABLE 1

| Ingredient | A | B | C | D | E | F |
|---|---|---|---|---|---|---|
| NORSOREX ※1 | 100 | 100 | 100 | 100 | | 100 |
| Alkyl benzene oil ※2 | 150 | 200 | 200 | 300 | | 200 |
| BR11 ※3 | | | | | 100 | |
| Zinc oxide | 5 | 5 | 5 | 5 | 5 | 5 |
| Stearic acid | 1 | 1 | 1 | 1 | 2 | 1 |
| Barium sulfate | 220 | 270 | 410 | 370 | 75 | 330 |
| Sulfur | 2.5 | 2.5 | 2.5 | 2.5 | 10 | 2.5 |
| Noccelar ZTC ※4 | 3 | 3 | 3 | 3 | | 3 |
| Noccelar DM ※5 | 2 | 2 | 2 | 2 | | 2 |
| Noccelar CZ ※6 | | | | | 1.5 | |
| Noccelar TT ※7 | | | | | 0.2 | |

※1: Poly norbornene rubber from Zeon Corporation
※2: Alkyl benzene oil from Zeon Corporation
※3: High cis polybutadiene from Japan Synthetic Rubber CO., LTD.
※4: Vulcanization accelerator from Ouchishinkou Chemical Industries Ltd., dibenzyl zinc dithiocarbamate
※5: Vulcanization accelerator from Ouchishinkou Chemical Industries Ltd., dibenzo thiazyl disulfide
※6: Vulcanization accelerator from Ouchishinkou Chemical Industries Ltd., N-cyclohexyl-2-benzothiazyl sulfene amide
※7: Vulcanization accelerator from Ouchishinkou Chemical Industries Ltd., tetra methyl thiuram disulfide (2) Production of Solid Core Compositions for an outer layer core of the blend shown in the following Table 2 were injection-molded directly on the inner layer core to obtain a solid core. The diameter of the obtained solid core is shown in the last Table 4. The Shore D hardness of the outer layer core is also shown in Table 4.

TABLE 2

| Ingredient | a | b | c | d | e |
|---|---|---|---|---|---|
| Hitrel 4767 ※1 | 100 | | | | |
| Elastollan ET680 ※2 | | 100 | | | |
| PEBAX 5523 ※3 | | | 100 | | |
| Hi-milan 1605 ※4 | | | | 50 | |
| Hi-milan 1705 ※5 | | | | 50 | |
| N230S ※6 | | | | | 100 |
| Zinc oxide | | | | | 5 |
| Stearic acid | | | | | 1.5 |
| FEF Black | | | | | 20 |
| FT Black | | | | | 30 |
| DOP | | | | | 10 |
| Noclac ODA ※7 | | | | | 1.5 |

TABLE 2-continued

| Ingredient | a | b | c | d | e |
|---|---|---|---|---|---|
| Noccelar CZ | | | | | 1.5 |
| Sulfur | | | | | 0.3 |

※1: Polyester based thermoplastic elastomer from Toray-DuPont Co., Ltd.
※2: Polyurethane based thermoplastic elastomer from Takeda Badische Urethane Industries Ltd.
※3: Polyamide based thermoplastic elastomer from Toray Co., Ltd.
※4: Sodium ion neutral ethylene-methacrylic acid copolymer based ionomer resin from Mitsui-DuPont Polychemical Co., Ltd.
※5: Zinc ion neutral ethylene-methacrylic acid copolymer based ionomer resin from Mitsui-DuPont Polychemical Co., Ltd.
※6: Acrylonitrile butadiene rubber (NBR) from Japan Synthetic Rubber CO., LTD.
※7: Antioxidant from Ouchishinkou Chemical Industries Ltd., alkylation diphenyl amine (3) Formation of Thread-Wound Layer Rubber thread having basic rubber of the blend of natural rubber/low cis isoprene rubber (Shell IR-309 of Shell Chemical Corporation)=50/50 (weight ratio) was wound around the foregoing solid center to produce a thread wound core of 39.0 mm in outer diameter.

(4) Preparation of Cover Composition

The cover blend materials shown in the following Table 3 were mixed using a two-shaft kneading type extruder to obtain cover compositions in the form of pellets. The conditions of extrusion were as follows:

Screw diameter: 45 mm

Screw rotating speed: 200 rpm

Screw L/D: 35

The blended compound was heated to 200–260° C. at the position of the die in the extruder.

TABLE 3

| | Blend | I | II | III |
|---|---|---|---|---|
| Ionomer resin | Surlyn 9945 ※1 | 25 | 25 | 20 |
| | Surlyn 8945 ※2 | 25 | 25 | 20 |
| Thermoplastic elastomer | Epofriend A1010 ※3 | 15 | 15 | 20 |
| | Septon HG-252 ※4 | 35 | 35 | 40 |
| Tackifier | Clearon P105 ※5 | 20 | | |
| | Ester gum H ※6 | | 20 | |
| Titanium dioxide | | 2 | 2 | 2 |
| Barium sulfate | | 2 | 2 | 2 |

※1: Zinc ion neutralized ethylene-methacrylic acid copolymer based ionomer resin from DuPont Co., Ltd. MI = 3.4, flexural modulus = approximately 220 Mpa
※2: Sodium ion neutralized ethylene-methacrylic acid copolymer based ionomer resin from DuPont Co., Ltd. MI = 4.4, flexural modulus = approximately 280 Mpa
※3: Including polybutadiene block containing epoxy group from Daicel Chemical Industries Ltd. Block copolymer of SBS structure, JIS-A hardness = 67, styrene/butadiene = 40/60 (weight ratio), containing approximately 1.5~1.7% by weight epoxy
※4: Hydrogenated styrene-isoprene-styrene block copolymer (SIS structure) with —OH group added to chainterminal from Kuraray Co., Ltd. JIS-A hardness = 80, contained styrene: 40% by weight
※5: Hydrogenated terpene resin from Yasuhara Chemical Co., Ltd.
※6: Hydrogenated rosin ester resin from Arakawa Chemical Industries A hemispherical half shell was molded using the obtained cover composition. Two thereof were used to enclose the obtained foregoing thread wound core. Thermal press formation was applied within the mold. Paint was applied on the surface to produce a golf ball having the outer diameter of 42.8 mm.

The cover hardness (Shore D hardness), the performance of the ball such as the initial velocity, spin rate and carry as well as the hit feeling were assessed for respective golf balls. The results are shown in Table 4.

TABLE 4

| | | Example | | | | Comparative Example | | | |
|---|---|---|---|---|---|---|---|---|---|
| | | 1 | 2 | 3 | 4 | 1 | 2 | 3 | 4 |
| Inner layer core | Blend | A | B | C | D | E | F | B | B |
| | Diameter (mm) | 29.5 | 27.5 | 25.5 | 27.5 | 27.5 | 27.5 | 27.5 | 27.5 |
| | Hardness (JISA) | 40 | 30 | 30 | 20 | 75 | 30 | 30 | 30 |
| Outer layer core | Blend | a | a | c | b | b | d | e | a |
| | Hardness (Shore D) | 47 | 47 | 55 | 25 | 25 | 63 | 15 | 47 |
| Core Diameter (mm) | | 33.5 | 31.5 | 29.5 | 31.5 | 31.5 | 31.5 | 31.5 | 31.5 |
| Cover | Blend | I | I | I | II | I | I | I | III |
| | Hardness (Shore D) | 49 | 49 | 49 | 48 | 49 | 49 | 49 | 49 |
| Physical Property | Wood No. 1 45 m/s | | | | | | | | |
| | Ball initial velocity (m/s) | 64.6 | 64.7 | 64.6 | 64.8 | 64.8 | 64.7 | 63.8 | 64.9 |
| | Spin rate (rpm) | 2700 | 2800 | 2920 | 2720 | 3330 | 2850 | 2830 | 2780 |
| | Carry - (yard) | 222.5 | 223.0 | 221.5 | 222.5 | 217.5 | 222.0 | 214.0 | 224.0 |
| | SW 20 m/s | | | | | | | | |
| | (1) Spin rate under dry condition (rpm) | 6800 | 7000 | 7150 | 6850 | 7230 | 7100 | 6950 | 6980 |
| | (2) Spin rate under wet condition (rpm) | 4010 | 4270 | 4290 | 3970 | 4260 | 4120 | 4150 | 2930 |
| | (3) Spin maintenance (%) | 59.0 | 61.0 | 60.0 | 58.0 | 58.9 | 58.0 | 59.7 | 42.0 |
| | Hit feeling | ○ | ○ | ○ | ○ | x | x | ○ | ○ |

The physical properties of the ball were assessed according to the following ways.

(1) Flight Performance, Spin Rate

The number 1 wood (W#1) club was attached to the swing robot of True temper. The golf ball was hit at the head speed of 15 m/second. The ball initial velocity, spin rate and carry (the flight distance up to the drop point) were measured. The spin rate was obtained by using the sequential photographs of the shot golf ball. Also, a sandwedge club (SW) was attached to the swing robot of True temper. The golf ball was hit at the head speed of 20 m/second to obtain the spin rate.

Measurements were carried out under the normal dry condition and under the wet condition in which the ball and the club face were wetted with moisture.

The spin maintenance is defined as the value of spin rate under wet condition/spin rate under dry condition×100.

(2) Hit Feeling

The golf balls were actually shot by ten professional golfers to obtain assessment. The determination criteria are as follows.

Determination criteria

○: at least eight out of the ten professional golfers expressed favorable soft feeling.

X: at least eight out of the ten professional golfers expressed unsatisfactory hard hit feeling.

The tested results of the golf balls of Examples 1–4 and Comparative Examples 1–4 are shown in Table 4. It is appreciated that the golf balls of the present invention are superior than the golf balls of the Comparative Examples in flight distance, spin maintenance, and hit feeling. The golf ball of Comparative Example 1 exhibits a large spin rate when hit by a driver with inferior flight distance and hit feeling since the inner layer core is too hard. The golf ball of Comparative Example 2 exhibits unfavorable hit feeling since the outer layer core is too hard. The golf ball of Comparative Example 3 cannot have the ball initial velocity and the flight distance increased since acrylonitrile butadiene rubber (NBR) is employed for the outer layer core. The golf ball of Comparative Example 4 exhibits low spin maintenance since a tackifier is not blended in the cover.

In the thread-wound golf ball of the present invention including a solid core formed of an inner layer core constituted by a vulcanizate of a soft rubber composition having a diameter of 24–33 mm and the JIS-A hardness of 5–50, and an outer layer core having a Shore D hardness of 10–60, surrounding the inner layer core, the cover material is blended with a thermoplastic elastomer including ionomer resin and rubber composition and also a tackifier. Therefore, the golf ball of the present invention is as soft as the conventional thread-wound golf ball with a liquid center to allow a favorable hit feeling. The spin rate is high and easily comes to a halt when shot with a short iron. Also, the flight distance can be improved. Furthermore, the spin maintenance, i.e. the ratio of the spin rate under wet condition to the spin rate under dry condition, is improved.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thread-wound golf ball comprising:

a core, a rubber thread layer surrounding said core, and a cover formed of a mixture of ionomer resin, thermoplastic elastomer, and a tackifier, said cover having a Shore D hardness of at least 40 and not more than 65, wherein said core is a two-layered core including an inner layer core having a diameter of 24–33 mm and a JIS-A hardness of at least 5 and not more than 50, and an outer layer core of 0.5–5 mm in thickness surrounding said inner layer core, and having a Shore D hardness of at least 10 and not more than 60, diameter of 25–35 mm, constituted by thermoplastic resin and/or thermoplastic elastomer.

2. The thread-wound golf ball according to claim 1, wherein said thermoplastic elastomer constituting said cover includes a member selected from the group consisting of a styrene butadiene-styrene block copolymer (SBS structure), a hydrogenate thereof, and a modified product thereof.

3. The thread-wound golf ball according to claim 1, wherein said thermoplastic elastomer constituting said cover includes a member selected from the group consisting of a styrene-isoprene-styrene block copolymer (SIS structure), a hydrogenate thereof, and a modified product thereof.

4. The thread-wound golfball according to claim 1, wherein said tackifier includes a member selected from the group consisting of terpene resin, rosin ester resin, and a mixture thereof.

5. The thread-wound golf ball according to claim 1, wherein said thermoplastic elastomer constituting said outer layer core includes a mixture of one or at least two types of polystyrene based elastomer, polyolefin based elastomer, polyurethane based elastomer and polyester based elastmer.

6. A golf ball comprising:

a core, wherein said core is a two-layered core including an inner layer having a JIS-A hardness of at least 5 and not more than 50, a rubber thread layer surrounding said core, and a cover formed of a mixture of ionomer resin, thermoplastic elastomer, and a tackifier, having a Shore D hardness of at least 40 and not more than 65, wherein said tackifier includes a member selected from the group consisting of rosin ester resin and a mixture thereof.

7. A golf ball comprising:

a core, wherein said core is a two-layered core including an inner layer having a JIS-A hardness of at least 5 and not more than 50, a rubber thread layer surrounding said core, and a cover formed of a mixture of three components consisting of ionomer resin, thermoplastic elastomer, and a tackifier, having a Shore D hardness of at least 40 and not more than 65, wherein:

the blending ratio of the mixture of ionomer resin, the thermoplastic elastomer, and the tackifier is 30–70/20–60/10–30 with respect to 100 parts by weight of the total of the mixture of said three components.

8. A golf ball comprising:

a core, wherein said core is a two-layered core including an inner layer having a JIS-A hardness of at least 5 and not more than 50, a rubber thread layer surrounding said core, and a cover formed of a mixture of ionomer resin, thermoplastic elastomer, and a tackifier, having a Shore D hardness of at least 40 and not more than 65, wherein:

5–50 parts by weight of the tackifier is blended with respect to 100 parts by weight of the basic resin material of the cover thermoplastic elastomer constituting said outer layer core includes a mixture of one or at least two types of polystyrene based elastomer.

* * * * *